US008818765B2

(12) United States Patent
Hrncar et al.

(10) Patent No.: US 8,818,765 B2
(45) Date of Patent: Aug. 26, 2014

(54) SYSTEM AND METHOD TO MONITOR COMPRESSOR RACK OPERATION

(75) Inventors: Martin Hrncar, Prague (CZ); Radek Fisera, Prague (CZ)

(73) Assignee: Honeywell International Inc., Morristown, NJ (US)

( * ) Notice: Subject to any disclaimer, the term of this patent is extended or adjusted under 35 U.S.C. 154(b) by 673 days.

(21) Appl. No.: 13/101,902

(22) Filed: May 5, 2011

(65) Prior Publication Data

US 2012/0283990 A1 Nov. 8, 2012

(51) Int. Cl.

| | |
|---|---|
| ***G06F 11/00*** | (2006.01) |
| ***G21C 17/00*** | (2006.01) |
| ***F25B 49/02*** | (2006.01) |

(52) U.S. Cl.

CPC ..... *F25B 49/022* (2013.01); *F25B 2600/022* (2013.01)

USPC ..... 702/196; 702/185

(58) Field of Classification Search

CPC ..... F25B 2600/022; F25B 49/022

USPC ..... 702/185, 196

See application file for complete search history.

(56) References Cited

U.S. PATENT DOCUMENTS

| | | | | |
|---|---|---|---|---|
| 5,594,665 | A * | 1/1997 | Walter et al. | 700/301 |
| 7,403,850 | B1 * | 7/2008 | Boutin et al. | 701/107 |
| 2002/0083773 | A1 * | 7/2002 | Ben-Romdhane | 73/660 |
| 2007/0114291 | A1 * | 5/2007 | Pouchak | 236/44 C |

* cited by examiner

*Primary Examiner* — Janet Suglo

(74) *Attorney, Agent, or Firm* — Schwegman Lundberg & Woessner, P.A.

(57) ABSTRACT

A commercial refrigeration system receives data from a plurality of compressors in a compressor rack, and uses the data to model a steady state amp draw for each of the compressors in the compressor rack. The system receives additional data from the plurality of compressors, and determines a steady state amp draw for each of the compressors from the additional data. The system then compares the amp draw from the additional data with the steady state amp draw model, and identifies a compressor fault based on the comparison of the steady state amp draw from the additional data with the steady state amp draw model.

12 Claims, 11 Drawing Sheets

SYSTEM AND METHOD TO MONITOR COMPRESSOR RACK OPERATION

TECHNICAL FIELD

The present disclosure relates to a system and method to monitor compressor rack operation.

BACKGROUND

In a commercial refrigeration system, a compressor rack represents one of the most expensive part of the system. Consequently, the effective operation of a compressor rack can be very important. One of the commonly used control optimality measures directly related to compressor rack operation can be the rate of change typically derived from a suction pressure measurement. The aim is usually to keep the suction pressure rate of change value within a reasonable range since it directly corresponds to the switching/staging rate in a parallel compressor rack. However, even if a system maintains the suction pressure rate of change within a reasonable range, there is no drill down capability, that is, there is no information about the load distribution among the individual compressors in the rack.

Moreover, in vapor-compression systems, compressor-related faults represent the largest part of service costs. Faults typically related to a reciprocating compressor in the rack can be divided into two major groups according to their impact on an individual compressor amp draw. First, there are faults resulting in a higher amp consumption (mechanical faults, e.g. increased friction), and second, faults resulting in an amp consumption decrease (e.g., a valve leak) in comparison with the referential value obtained under same driving conditions. Both types of faults cause an efficiency decrease of the compressor. Early diagnostics in commercial refrigeration systems can reduce the equipment downtime as well as service costs. Approaches presently available however cannot be applied to an individual compressor operating in a compressor rack. The available approaches consider either a simple single compressor system or monitor the whole compressor rack performance. So as noted above, drill-down capability (fault diagnostics) is somewhat limited. The other group of approaches is based on additional (and rarely available) information from the compressor manufacturer (e.g., so-called compressor maps).

DETAILED DESCRIPTION

Figure 1:
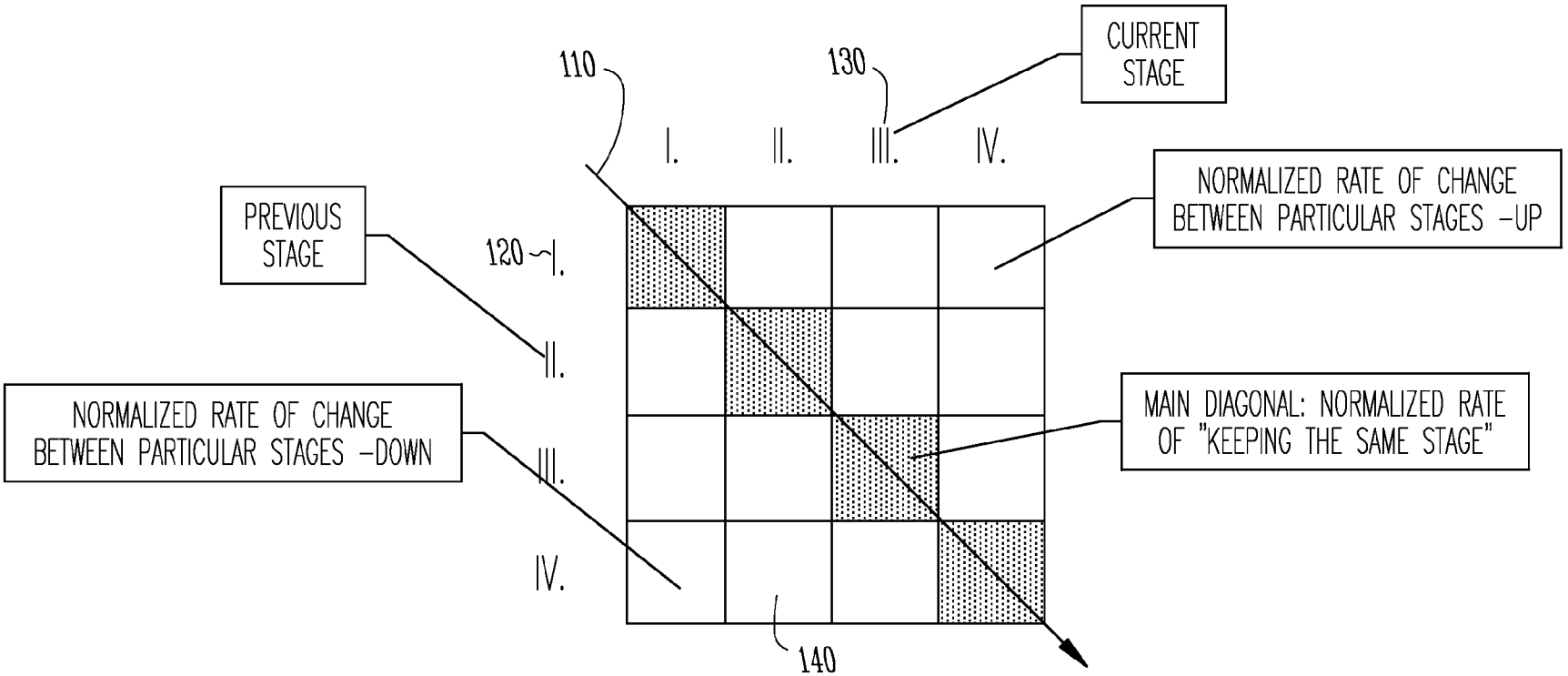
FIG. 1 is a matrix containing normalized values of compressor stage usage and normalized rates of switching between stages.

In an embodiment, statistics and their visualizations illustrate a novel view of compressor rack operation. The statistics are based on commonly available sensor set data in U.S. supermarkets. A staging matrix is generated, and it captures the transitions among individual compressor rack stages within a selected time window. The calculated staging matrix hence describes the cooling load distribution among particular stages. Each stage is represented by the particular combination of running compressors. In other words, the amount of time spent in each stage within the observed window is calculated together with the staging (switch from one particular stage to another) statistic. Excessive staging can signal either damage to one or more compressors in the rack (e.g., a valve leak), or it can point to excessive load change in the system. Both of these cases can lead to intensive compressor rack deterioration. Therefore, the staging statistic thresholds (either constant or adaptive) can be set, and if the thresholds are exceeded an alarm can be generated.

Another feature is a visualization of the calculated statistics. A graphical output provides easy to understand information (in the form of stacked area plot with adjustable color coding) about the time development of the compressor rack workload relative distribution among stages as well as the switching rate. Additionally, data drill down capability is enabled by the plot in the same way the distribution between individual compressors is enabled. The plot permits an estimation of the operational time of individual compressors. The operational time is usually proportional to the extent of the wear on the compressors.

Another embodiment is once again based on the sensor set typically available in U.S. supermarkets. The steady state amp draw of each compressor in the compressor rack can be modeled based on selected inputs. Deviations from this identified baseline can signal improper functioning of a particular compressor that is probably caused by one of the above-mentioned faults. The fault thus can be detected, reported, and monetized. An embodiment compares measured steady state amp draw of each running compressor with the model based baseline and detects any deviation (anomaly). The model is based on well-known Air Conditioning and Refrigeration Institute (ARI) equations augmented by selected compressor rack control signals. The model is identified based on historical data (best known behavior, commissioning, etc.), and current steady state energy consumption is predicted. Detected events are reported virtually in almost real time and visualized for easy identification of a detected fault. The only assumption that should be made about the control strategy is that the missing capacity of a faulty compressor is compensated for by other compressors in the rack. This assumption is satisfied in overwhelming majority of instances.

In comparison to the current state of the art products, these embodiments bring several advantages. The embodiments do not require knowledge of the detailed compressor data, e.g., rarely available compressor map equation coefficients. Models can be built automatically for each compressor in the rack from a short interval (~weeks) of healthy data, and the building of the models does not require additional sensor installation. These features allow for achieving higher scalability and fast deployment ability. Moreover, the embodiments provide precise results with high sensitivity.

In a mode of operation, all the related signals (individual compressor amp draws, control signals) are first collected.

The signals are validated to avoid results degradation, for example, by a frozen sensor. The total number of compressors in the rack is assumed to be known. Then the staging signal describing actual compressor rack stage (actual combination of running compressors) is derived either from current draw data or from control signals. In an embodiment, current draws are preferred so as to prevent problems caused by control signals override or a faulty compressor. The total number of stages used by the compressor rack to match the load is determined by the properties of the staging signal.

Within the selected time window, a square staging matrix 100, as illustrated in FIG. 1, wherein the number of rows 120 and columns 130 are equal to the number of rack stages, is filled with the values according to the staging signals as follows. A matrix element 140 [i,j] represents the average number of shifts from i-th to the j-th stage within the window. As the window slides, the normalized time series of staging matrices (i.e. a moving average) is obtained. The values on the main diagonal 110 represent the relative amount of time spent in the particular stage within the time window. The values outside the main diagonal 110 represent the relative number of switches among particular stages, that is, the sum of values outside the main diagonal 110 corresponds to the rate of change (switching rate) within the time window. The switching rate can be compared to a predefined threshold and an alarm for the operator can be generated. Alternatively, a vector of compressor average engagement can be calculated from the staging signal. The values of this vector in each time instance represent relative engagement (operational) time of each compressor within the sliding time window selected earlier.

Figure 2:
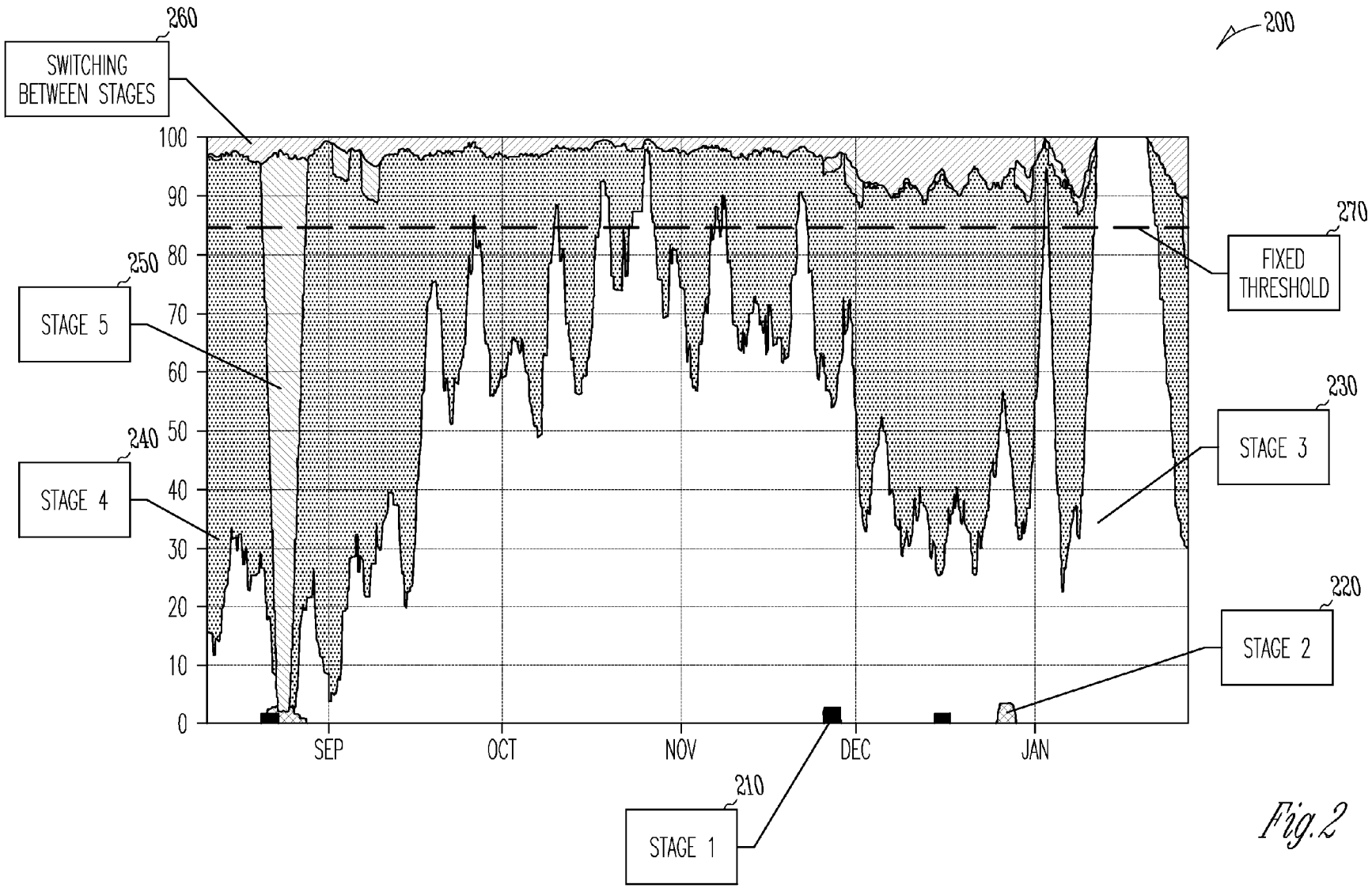
FIG. 2 is a plot indicating the duration of time a compressor stage is in operation and frequency of transitions between stages.
Figure 3:
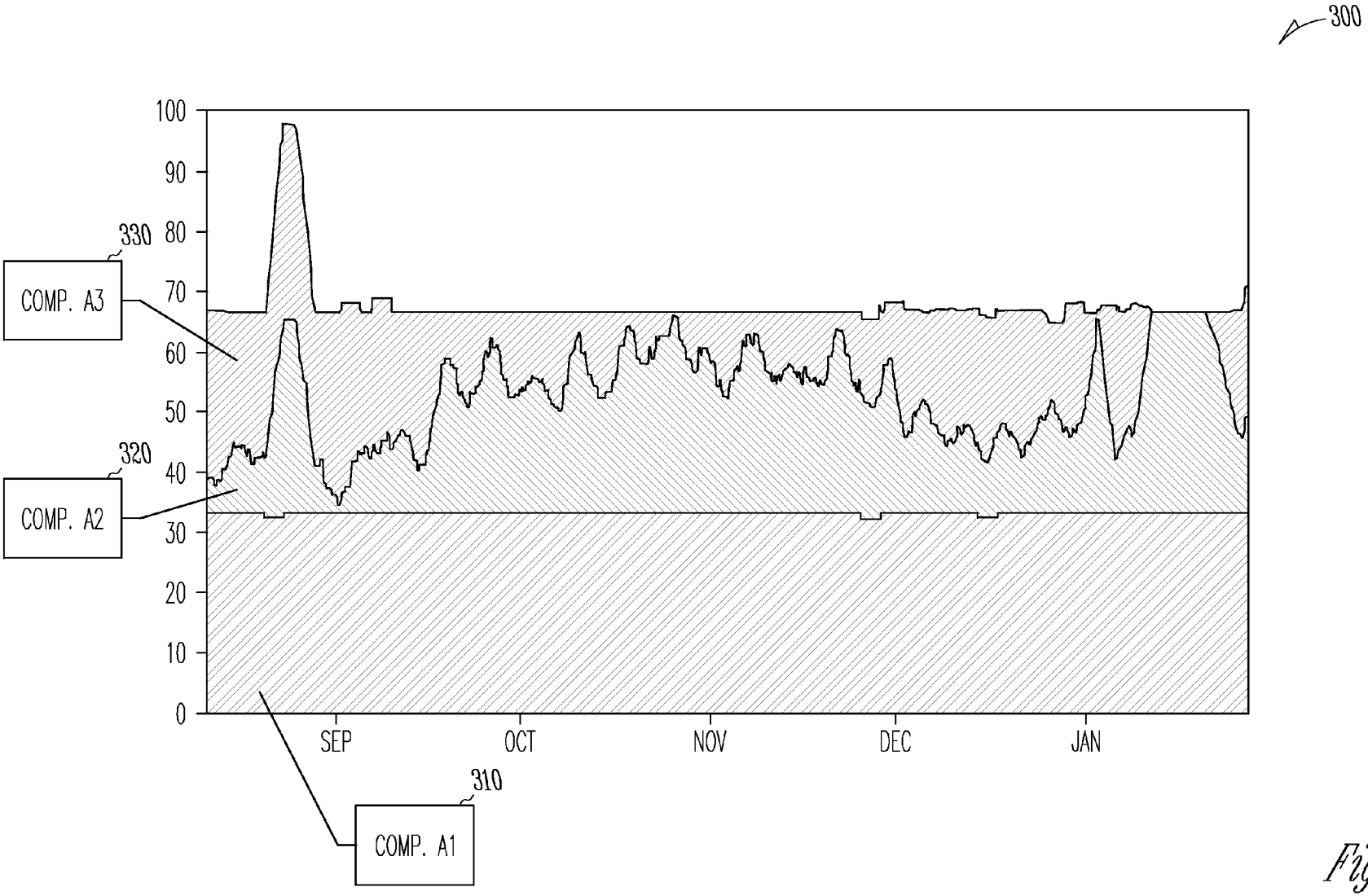
FIG. 3 is a plot indicating compressor workload distribution.

The results from both approaches can be visualized in the form of stacked area plots, as are illustrated in FIGS. 2 and 3. The plot 200 in FIG. 2 displays the time development of the compressor rack workload relative distribution among stages and the switching rate. More specifically, FIG. 2 illustrates five stages of a compressor rack—Stage 1 (210), Stage 2 (220), Stage 3 (230), Stage 4 (240), and Stage 5 (250). Each stage can have an identifying color associated with it, which can be changed by a user. As an example, in the time period just before January, Stage 2 was operating less than 5% of the time, while Stage 3 was operating about 50% of the time, and Stage 4 was operating about 40% of the time. FIG. 2 further illustrates at 260 that during this time, about 5% of the time was occupied by switching between stages. FIG. 2 further illustrates a threshold 270, which when it is exceeded by the switching between stages area 260, signals excessive staging and can indicate a fault.

FIG. 3 is a plot 300 that displays drill-down information about the individual compressor engagement (operational time) as it is developing in time. In the example of FIG. 3, there are three compressors 310, 320, and 330 in the compressor rack. FIG. 3 shows that each compressor can achieve a maximum relative engagement of 33.3%. Then, for example, at the beginning of October, compressor 310 was running at its maximum of 33.3%, compressor 320 was running at approximately 20%, and compressor 330 was running at approximately 14%. An embodiment can produce the results of FIGS. 2 and 3 either online with delay proportional to the window length or offline.

FIGS. 4, 5A, 5B, 7, 8A, and 8B are flowcharts of example processes 400, 500, 700, and 800 for monitoring compressor rack operation. FIGS. 4, 5A, 5B, 7, 8A, and 8B include a number of process blocks 405-445, 505-575, 705-750, and 805-855. Though arranged serially in the example of FIGS. 4, 5A, 5B, 7, 8A, and 8B, other examples may reorder the blocks, omit one or more blocks, and/or execute two or more blocks in parallel using multiple processors or a single processor organized as two or more virtual machines or sub-processors. Moreover, still other examples can implement the blocks as one or more specific interconnected hardware or integrated circuit modules with related control and data signals communicated between and through the modules. Thus, any process flow is applicable to software, firmware, hardware, and hybrid implementations.

Figure 4:
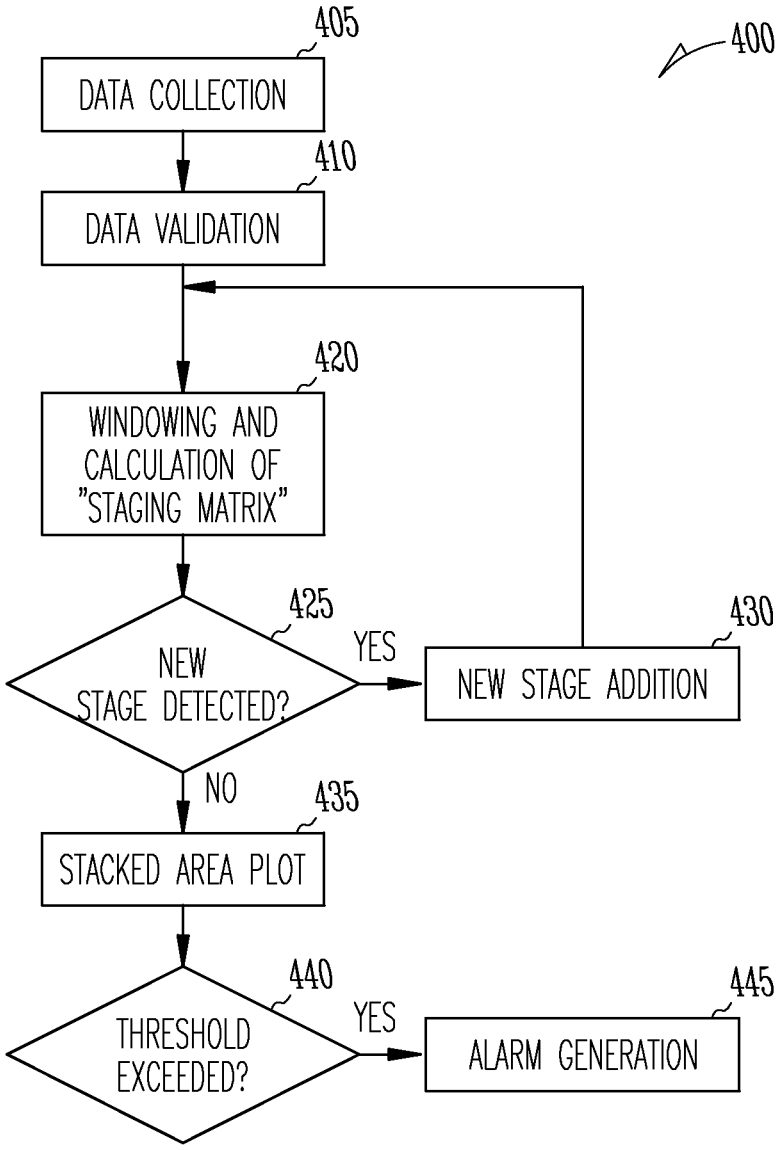
FIG. 4 is a flowchart of an example process to monitor compressor rack operation.

FIG. 4 is a flowchart illustrating the steps in an example process 400 to monitor compressor rack operation. At 405, data is collected from the compressor rack of a commercial refrigeration system. This data can include data that is commonly available from commercial refrigeration systems, such as current draws and control signals. At 410, the data is validated. Data validation helps avoid degradation of the results that can be caused by such things as, e.g., frozen sensors. At 420, a window is selected, and the staging matrix such as the matrix 100 of FIG. 1 is generated. At 425, a check is made for any new stage, and if a new stage is detected at 430, the staging matrix is regenerated and the window can be recalculated at 420. At 435, the stacked area plot, such as illustrated in FIGS. 2 and 3, is generated. If a threshold is exceeded at 440, an alarm is generated at 445.

Figure 5A:
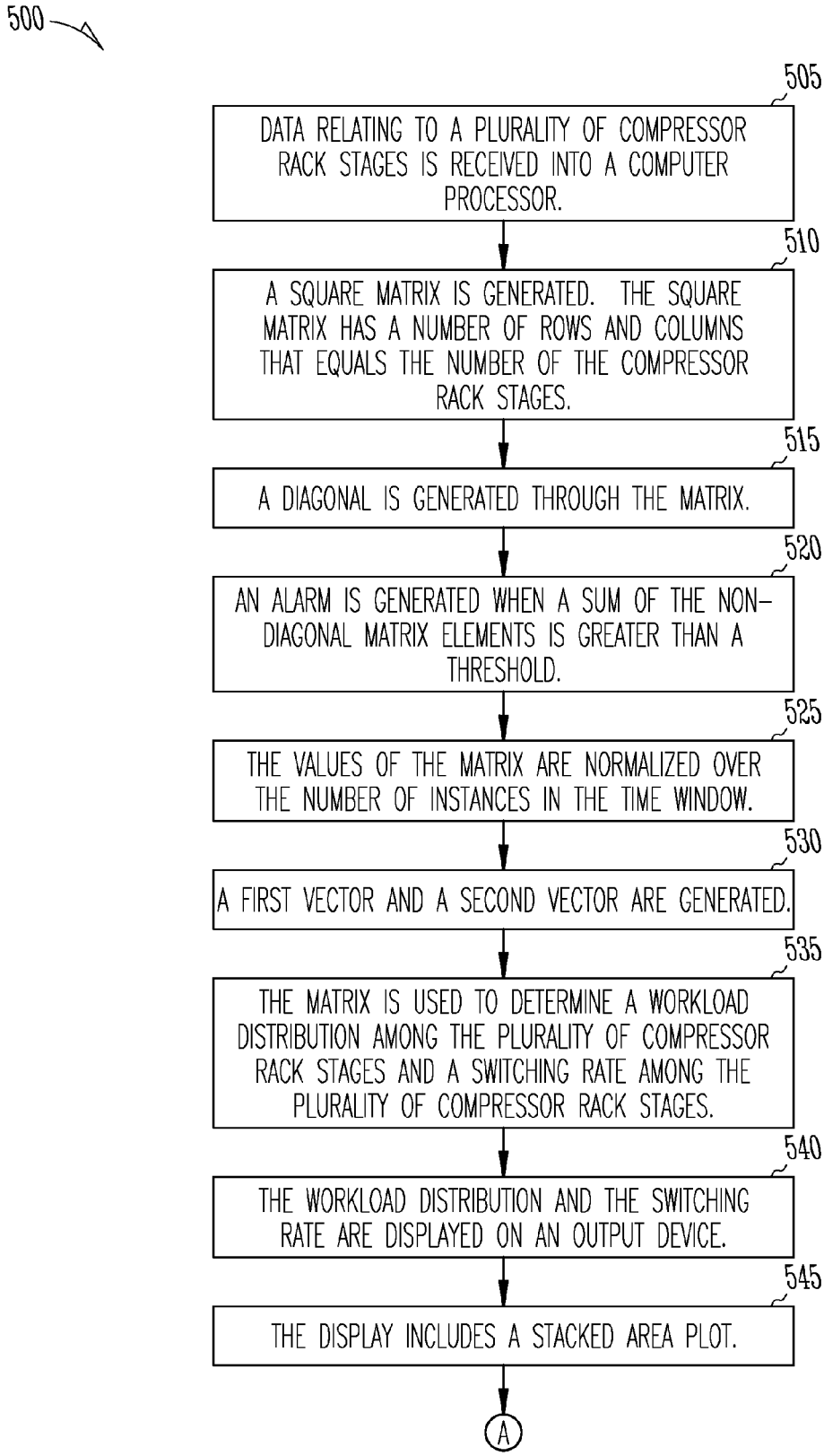
FIGS. 5A and 5B are a flowchart of another example process to monitor compressor rack operation.
Figure 5B:
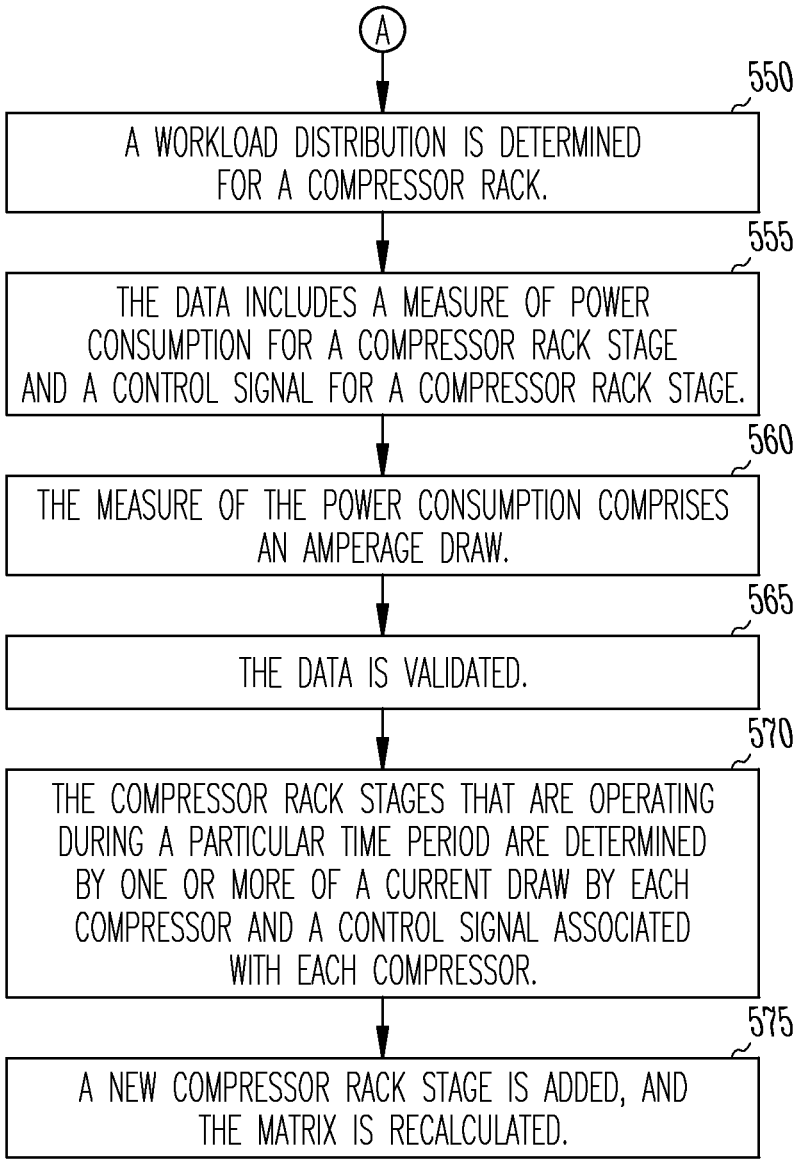

FIGS. 5A and 5B are a flowchart illustrating the steps in another example process 500 to monitor compressor rack operation. At 505, data relating to a plurality of compressor rack stages is received into a computer processor. The compressor rack stages include an identification of compressors operating during a particular time period. At 510, a square matrix is generated. The square matrix has a number of rows and columns that equals the number of the compressor rack stages. At 515, a diagonal is generated through the matrix. The value of a matrix element through which the diagonal passes represents a number of instances in a time window wherein the compressor rack stage identified by the row and column was operational. The value of a matrix element through which the diagonal does not pass represents a number of switches during the time window from a compressor rack stage represented by the row to a compressor rack stage represented by the column. At 520, an alarm is generated when a sum of the non-diagonal matrix elements is greater than a threshold.

At 525, the values of the matrix are normalized over the number of instances in the time window. At 530, a first vector and a second vector are generated. The first vector includes a value for each compressor in the compressor rack and represents a normalized duration of time that each compressor is in operation during the time window. The second vector includes a value for each compressor stage and represents a normalized duration of time that each compressor stage is in operation during the time window. The second vector can also include a value that represents a normalized number of instances that the compressor rack spends switching between stages during the time window.

At 535, the matrix is used to determine a workload distribution among the plurality of compressor rack stages and a switching rate among the plurality of compressor rack stages. At 540, the workload distribution and the switching rate are displayed on an output device. At 545, the display includes a stacked area plot. At 550, a workload distribution is determined for a compressor rack, i.e. the individual compressor workloads are evaluated.

At 555, the data includes a measure of power consumption for a compressor rack stage and a control signal for a compressor rack stage, and at 560, the measure of the power consumption comprises an amperage draw. At 565, the data is validated. At 570, the compressor rack stages that are operating during a particular time period are determined by one or more of a current draw by each compressor and a control signal associated with each compressor. At 575, a new compressor rack stage is added, and the matrix is recalculated.

In another embodiment, as noted above, selected measures (based on a typically available sensor set in U.S. supermarkets) representing working conditions together with control signals are collected from a system. A global multivariate linear regression model is identified on a short training interval of healthy steady state data (collected for example after the commissioning), thereby leveraging the extrapolation capability of a selected model. The exploited signals are first processed by a simple steady state detector. The model is then identified for each compressor in a rack to provide an estimate of steady state compressor amp draw at given driving conditions. These estimates can later be compared to the actual steady state amp draw of the compressor. If the measured consumption deviates from the predicted one for the same given inputs (driving conditions), an anomaly (fault) is indicated. Typically, a higher consumption is caused by compressor degradation or mechanical failure, and a lower consumption indicates a valve leak. The positive or negative deviations (can be further thresholded) are considered to be so called symptoms of the two types of faults mentioned above. Symptom values pointing to the particular fault are then properly aggregated in time, so the time development of fault relevancy is calculated according to pre-defined parameters (properly scaled aggregates). Finally, all outputs are visualized and can show trends of measured versus estimated amp draw for each compressor together with aggregated fault relevancy trends. These graphical outputs can be readily incorporated into some continuous commissioning tool dashboard.

The generation of the multivariate linear regression model (ARI equations) is as follows. A compressor rack of N compressors has a suction pressure and a suction temperature, and a discharge pressure and a discharge temperature. The discharge dew point temperature (DDT) for a rack is a function of the discharge pressure and the refrigerant type, suction dew point temperature (SDT) is a function of the suction pressure and the refrigerant type. The expected or referential steady state current for an individual compressor can be modeled as a function of the DDT, the SDT, the superheat, and the control signals. In most situations however, the superheat can be assumed to be constant. Then, the standard ARI model equation to model compressor current is as follows:

$$\hat{I} = a_0 + \sum_{i=1}^{3} a_i \cdot SDT^i + \sum_{i=4}^{6} a_i \cdot DDT^{i-3} + a_7 \cdot SDT \cdot DDT + a_8 \cdot SDT \cdot DDT^2 + a_9 \cdot SDT^2 \cdot DDT$$

The above equation is typically designed for one compressor type. However, it can be used with sufficient accuracy for almost all commonly used compressors in commercial refrigeration systems. This standard ARI equation can be augmented by additional variables such as compressor unloader signal (Unldr) and a variable for stage assignment (D, {0,1}), as indicated by the following equation:

$$\hat{I} = a_0 + \sum_{i=1}^{3} a_i \cdot SDT^i + \sum_{i=4}^{6} a_i \cdot DDT^{i-3} + a_7 \cdot SDT \cdot DDT +$$

-continued $$a_8 \cdot SDT \cdot DDT^2 + a_9 \cdot SDT^2 \cdot DDT + a_{10} \cdot Unldr + \sum_{k=1}^{Nst-1} a_{10+k} \cdot D_k$$

Figure 6:
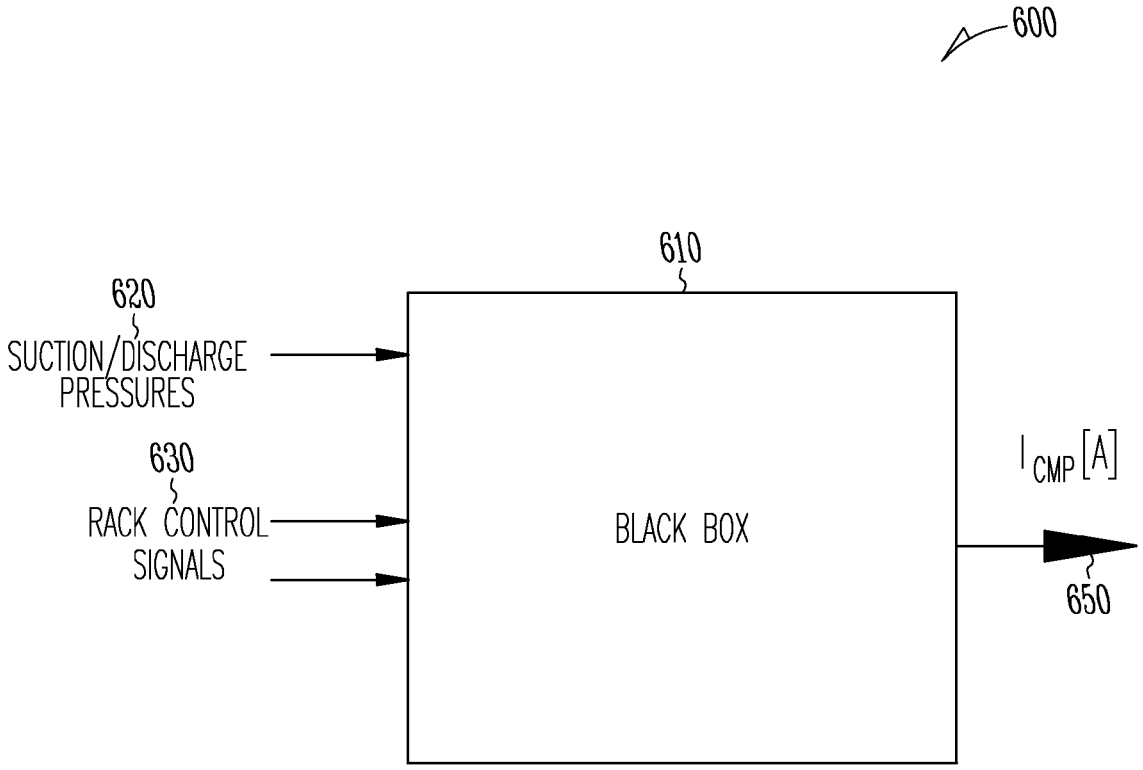
FIG. 6 is a block diagram illustrating the inputs used in determining a steady state amp draw.

FIG. 6 is a block diagram 600 that illustrates the inputs that are used to model at 610 the steady state amp draw of a compressor. Specifically, the inputs include a suction/discharge pressure 620, and a rack control signal 630. The result is the steady state amp draw 650.

Figure 7:
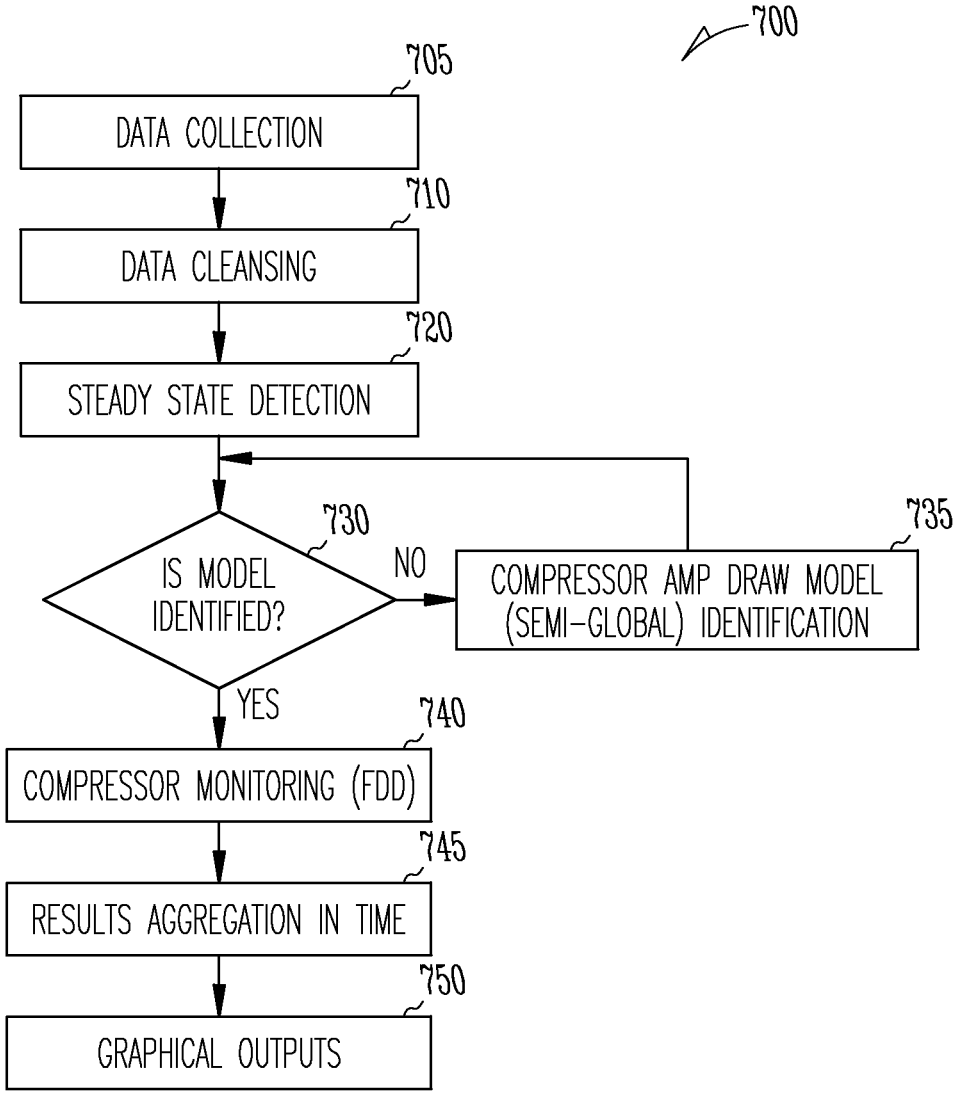
FIG. 7 is a flowchart of another example process to monitor compressor rack operation.

FIG. 7 is a flowchart of another example process 700 to monitor compressor rack operation. At 705, data is collected from compressors in a compressor rack. This data can include suction pressure, a discharge pressure, and compressor control signals. At 710, the data is cleansed. The cleansing of the data helps to avoid degradation of the results. At 720, a steady state is detected. At 730, it is determined if a model has been identified, and if not, at 735, a compressor amp draw model is identified. After a model has been identified at 730, a compressor is monitored at 740, the results are aggregated over time at 745, and the results are graphically output at 750.

Figure 8A:
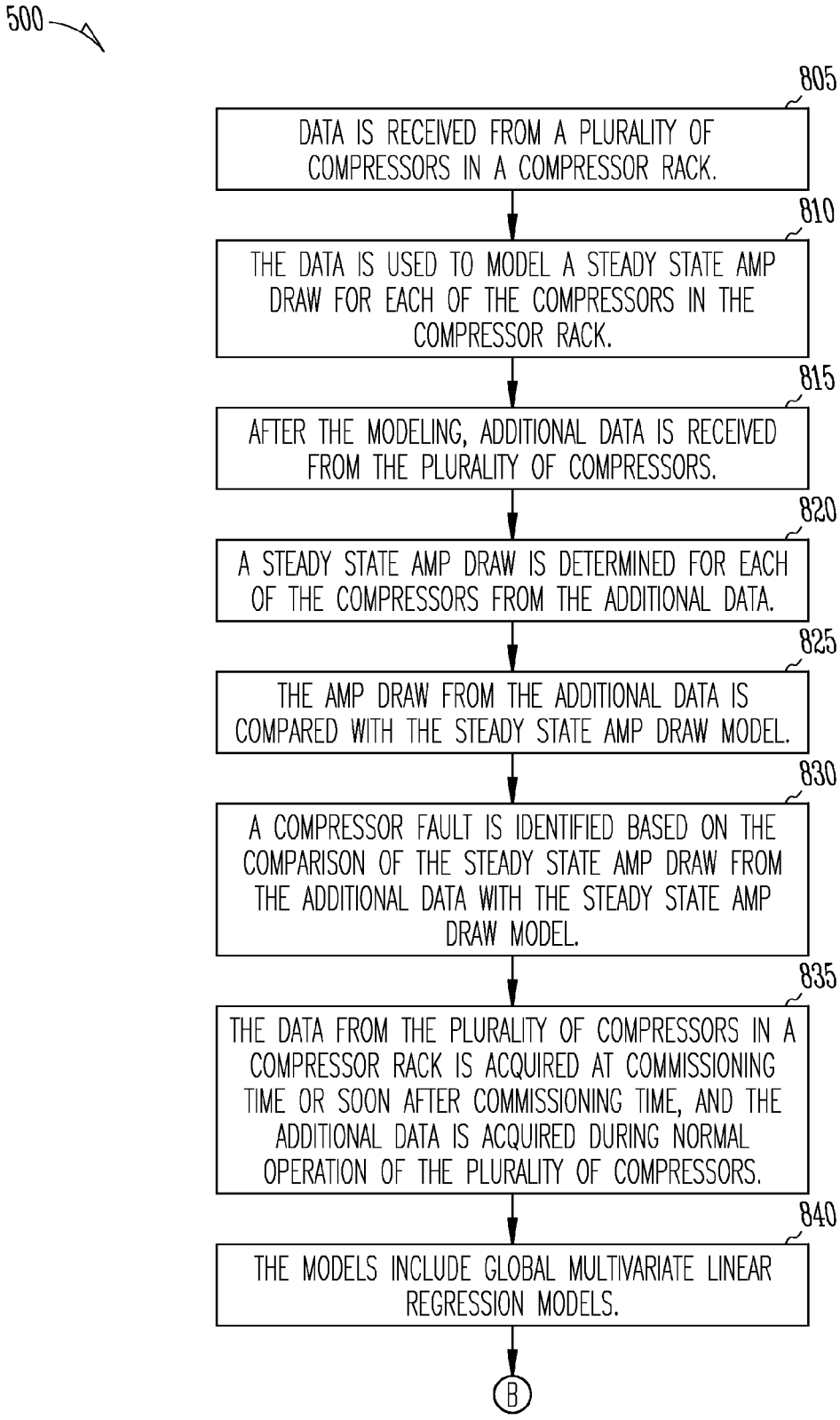
FIGS. 8A and 8B are a flowchart of another example process to monitor compressor rack operation.
Figure 8B:
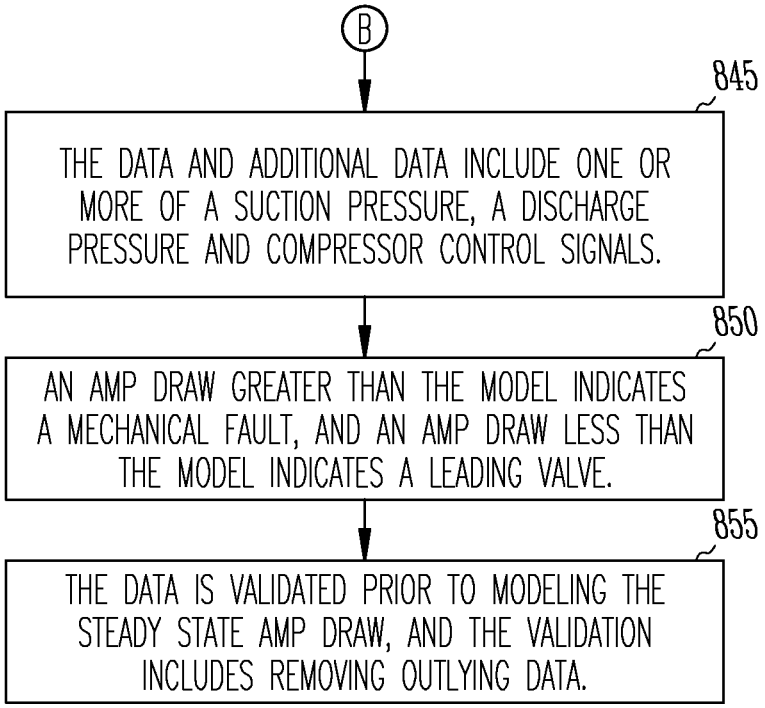

FIGS. 8A and 8B are a flowchart of another example process 800 to monitor compressor rack operation. At 805, data is received from a plurality of compressors in a compressor rack. At 810, the data is used to model a steady state amp draw for each of the compressors in the compressor rack. At 815, after the modeling, additional data is received from the plurality of compressors. At 820, a steady state amp draw is determined for each of the compressors from the additional data. At 825, the amp draw from the additional data is compared with the steady state amp draw model. At 830, a compressor fault is identified based on the comparison of the steady state amp draw from the additional data with the steady state amp draw model.

At 835, the data from the plurality of compressors in a compressor rack is acquired at commissioning time or soon after commissioning time, and the additional data is acquired during normal operation of the plurality of compressors. At 840, the models include global multivariate linear regression models. At 845, the data and additional data include one or more of a suction pressure, a discharge pressure, and compressor control signals. At 850, an amp draw greater than the model indicates a mechanical fault, and an amp draw less than the model indicates a leaking valve. At 855, the data is validated prior to modeling the steady state amp draw, and the validation includes removing outlying data.

Figure 9:
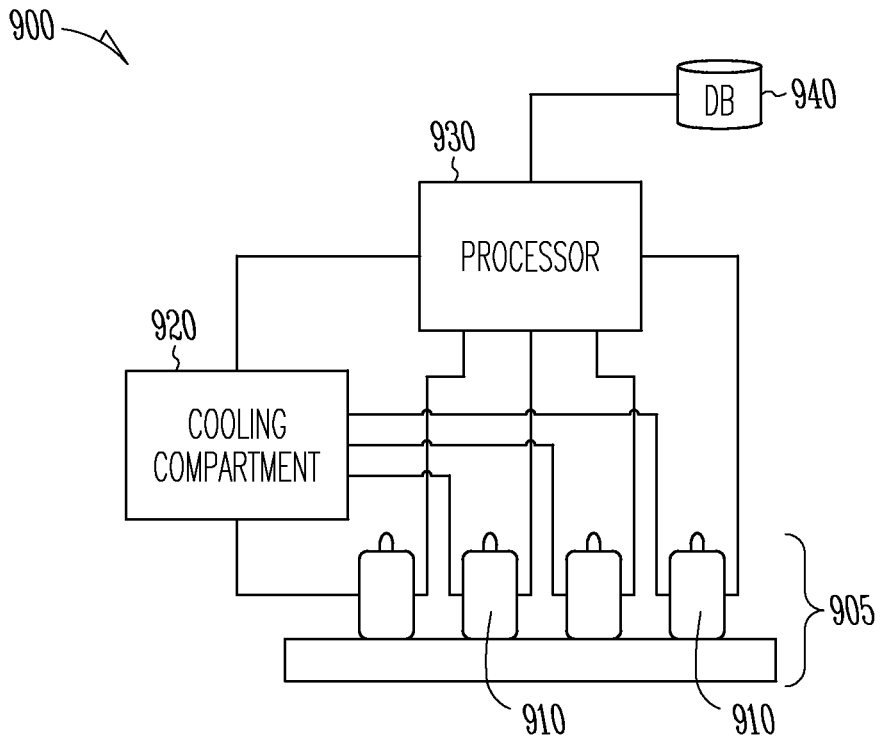
FIG. 9 is an example embodiment of a refrigeration system with a compressor rack.

FIG. 9 is an example embodiment of a refrigeration system 900. The system 900 includes a cooling compartment 920, a compressor rack 905 with compressors 910, and a processor 930 coupled to a database 940.

EXAMPLE EMBODIMENTS

Example No. 1 is a system comprising one or more computer processors that are configured to receive data from a plurality of compressors in a compressor rack; use the data to model a steady state amp draw for each of the compressors in the compressor rack; after the modeling, receive additional data from the plurality of compressors; determine a steady state amp draw for each of the compressors from the additional data; compare the amp draw from the additional data with the steady state amp draw model; and identify a compressor fault based on the comparison of the steady state amp draw from the additional data with the steady state amp draw model.

Example No. 2 includes the features of Example No. 1 and optionally includes a system wherein the data from the plurality of compressors in a compressor rack is acquired at commissioning time or soon after commissioning time, and the additional data is acquired during normal operation of the plurality of compressors.

Example No. 3 includes the features of Example Nos. 1-2 and optionally includes a system wherein the models comprise global multivariate linear regression models.

Example No. 4 includes the features of Example Nos. 1-3 and optionally includes a system wherein the data and additional data comprise one of more of a suction pressure, a discharge pressure, compressor control signals, and a timestamp.

Example No. 5 includes the features of Example Nos. 1-4 and optionally includes a system wherein an amp draw greater than the model indicates a mechanical fault, and an amp draw less than the model indicates a leaking valve.

Example No. 6 includes the features of Example Nos. 1-5 and optionally includes a system wherein the data is validated prior to modeling the steady state amp draw, and wherein the validation comprises removing outlying data.

Example No. 7 is a system comprising one or more computer processors that are configured to receive data relating to a plurality of compressor rack stages, the compressor rack stages comprising an identification of compressors operating during a particular time period; generate a square matrix, wherein a number of rows and columns of the square matrix equals a number of the compressor rack stages; generate a diagonal through the matrix, wherein a value of a matrix element through which the diagonal passes represents a number of instances in a time window wherein the compressor rack stage identified by the row and column was operational, and wherein a value of a matrix element through which the diagonal does not pass represents a number of switches during the time window from a compressor rack stage represented by the row to a compressor rack stage represented by the column; and generate an alarm when a sum of the non-diagonal matrix elements is greater than a threshold.

Example No. 8 includes the features of Example No. 7 and further includes a system wherein the one or more computer processors are configured to normalize the values of the matrix by the number of instances in the time window.

Example No. 9 includes the features of Example Nos. 7-8 and optionally includes a system wherein the one or more computer processors are configured to generate one or more of a first vector and a second vector, the first vector comprising a value for each compressor in the compressor rack representing a normalized duration of time that each compressor is in operation during the time window; and the second vector comprising a value for each compressor stage representing a normalized duration of time that each compressor stage is in operation during the time window and a value for each compressor stage representing a normalized number of instances that each compressor stage spent switching stages during the time window.

Example No. 10 includes the features of Example Nos. 7-9 and optionally includes a system wherein the one or more computer processors are configured to determine from the matrix a workload distribution among the plurality of compressor rack stages and a switching rate among the plurality of compressor rack stages.

Example No. 11 includes the features of Example Nos. 7-10 and optionally includes a system wherein the one or more computer processors are configured to generate a display of the workload distribution and the switching rate.

Example No. 12 includes the features of Example Nos. 7-11 and optionally includes a system wherein the display comprises a stacked area plot.

Example No. 13 includes the features of Example Nos. 7-12 and optionally includes a system wherein the one or more computer processors are configured to determine a workload distribution for a single compressor.

Example No. 14 includes the features of Example Nos. 7-13 and optionally includes a system wherein the data comprises a measure of power consumption for a compressor rack stage and a control signal for a compressor rack stage.

Example No. 15 includes the features of Example Nos. 7-14 and optionally includes a system wherein the measure of the power consumption comprises an amperage draw.

Example No. 16 includes the features of Example Nos. 7-15 and optionally includes a system wherein the one or more computer processors are configured to validate the data.

Example No. 17 includes the features of Example Nos. 7-16 and optionally includes a system wherein the compressor rack stages that are operating during a particular time period are determined by one or more of a current draw by each compressor and a control signal associated with each compressor.

Example No. 18 includes the features of Example Nos. 7-17 and optionally includes adding a new compressor rack stage, and recalculating the matrix.

Example No. 19 is a system comprising one or more computer processors configured to receive data from a plurality of compressors in a compressor rack; use the data to model a steady state amp draw for each of the compressors in the compressor rack; receive additional data from the plurality of compressors; determine a steady state amp draw for each of the compressors from the additional data; compare the amp draw from the additional data with the steady state amp draw model; and identify a compressor fault based on the comparison of the steady state amp draw from the additional data with the steady state amp draw model.

Example No. 20 includes the features of Example No. 19 and optionally includes a system wherein the additional data is received after the modeling, and wherein the data from the plurality of compressors in a compressor rack is acquired at commissioning time or soon after commissioning time, and the additional data is acquired during normal operation of the plurality of compressors.

It should be understood that there exist implementations of other variations and modifications of the invention and its various aspects, as may be readily apparent, for example, to those of ordinary skill in the art, and that the invention is not limited by specific embodiments described herein. Features and embodiments described above may be combined with each other in different combinations. It is therefore contemplated to cover any and all modifications, variations, combinations or equivalents that fall within the scope of the present invention.

Thus, an example system for monitoring a compressor rack has been described. Although specific example embodiments have been described, it will be evident that various modifications and changes may be made to these embodiments without departing from the broader spirit and scope of the invention. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate example embodiment.

The invention claimed is:

1. A system comprising:

one or more computer processors configured to:

receive data relating to a plurality of compressor rack stages, the compressor rack stages comprising an identification of compressors operating during a particular time period;

generate a square matrix, wherein a number of rows and columns of the square matrix equals a number of the compressor rack stages;

generate a diagonal through the matrix, wherein a value of a matrix element through which the diagonal passes represents a number of instances in a time window wherein the compressor rack stage identified by the row and column was operational, and wherein a value of a matrix element through which the diagonal does not pass represents a number of switches during the time window from a compressor rack stage represented by the row to a compressor rack stage represented by the column; and generate an alarm when a sum of the non-diagonal matrix elements is greater than a threshold.

2. The system of claim 1, wherein the one or more computer processors are configured to normalize the values of the matrix by the number of instances in the time window.

3. The system of claim 1, wherein the one or more computer processors are configured to generate one or more of a first vector and a second vector, the first vector comprising a value for each compressor in the compressor rack representing a normalized duration of time that each compressor is in operation during the time window; and the second vector comprising a value for each compressor stage representing a normalized duration of time that each compressor stage is in operation during the time window and a value that represents a normalized number of instances that the compressor rack spends switching between stages during the time window.

4. The system of claim 1, wherein the one or more computer processors are configured to determine from the matrix a workload distribution among the plurality of compressor rack stages and a switching rate among the plurality of compressor rack stages.

5. The system of claim 4, wherein the one or more computer processors are configured to generate a display of the workload distribution and the switching rate.

6. The system of claim 5, wherein the display comprises a stacked area plot.

7. The system of claim 4, wherein the one or more computer processors are configured to determine a workload distribution for a single compressor.

8. The system of claim 1, wherein the data comprises a measure of power consumption for a compressor rack stage and a control signal for a compressor rack stage.

9. The system of claim 8, wherein the measure of the power consumption comprises an amperage draw.

10. The system of claim 1, wherein the one or more computer processors are configured to validate the data.

11. The system of claim 1, wherein the compressor rack stages that are operating during a particular time period are determined by one or more of a current draw by each compressor and a control signal associated with each compressor.

12. The system of claim 1, comprising adding a new compressor rack stage, and recalculating the matrix.

* * * * *